US009063503B2

(12) United States Patent
Yamauchi et al.

(10) Patent No.: US 9,063,503 B2
(45) Date of Patent: Jun. 23, 2015

(54) SEPARATING DEVICE

(75) Inventors: Hirokazu Yamauchi, Osaka (JP); Junya Masuda, Osaka (JP)

(73) Assignee: SHARP KABUSHIKI KAISHA, Osaka (JP)

( * ) Notice: Subject to any disclaimer, the term of this patent is extended or adjusted under 35 U.S.C. 154(b) by 32 days.

(21) Appl. No.: 13/430,842

(22) Filed: Mar. 27, 2012

(65) Prior Publication Data

US 2012/0257916 A1 Oct. 11, 2012

(30) Foreign Application Priority Data

Apr. 8, 2011 (JP) ..... 2011-086298

(51) Int. Cl.
*G03G 15/14* (2006.01)
*G03G 15/00* (2006.01)

(52) U.S. Cl.
CPC ..... *G03G 15/6532* (2013.01); *G03G 2215/004* (2013.01); *G03G 15/657* (2013.01); *G03G 2215/00573* (2013.01)

(58) Field of Classification Search
CPC ..... G03G 2215/004; G03G 2215/00573; G03G 15/6532
USPC ..... 399/398, 399
See application file for complete search history.

(56) References Cited

U.S. PATENT DOCUMENTS 4,119,308 A * 10/1978 Hamaker ..... 271/313
4,752,811 A * 6/1988 Takahashi ..... 399/399
5,448,347 A * 9/1995 Mills ..... 399/323

FOREIGN PATENT DOCUMENTS

| | | | |
|---|---|---|---|
| JP | 61-200564 A | | 9/1986 |
| JP | 62-242981 A | | 10/1987 |
| JP | 2-126276 A | | 5/1990 |
| JP | 9-204106 A | | 8/1997 |
| JP | 11-219035 A | | 8/1999 |
| JP | 2003-195647 A | | 7/2003 |
| JP | 2009-265292 A | | 11/2009 |
| JP | 2009265292 A | * | 11/2009 |

* cited by examiner

*Primary Examiner* — Daniel J Colilla
*Assistant Examiner* — John M Royston
(74) *Attorney, Agent, or Firm* — Birch, Stewart, Kolasch & Birch, LLP

(57) ABSTRACT

The separating part of the separating device receives a reactive force that occurs on the outer peripheral surface of the photoreceptor drum, at the contact point where the separating part and the photoreceptor drum are in contact. The separating device controller changes the position of the rotational supporting point so as to decrease the rotational moment M of the reactive force at the rotational supporting point of the separating device, in accordance with increase of the reactive force that occurs on the outer peripheral surface of the photoreceptor drum as the separating part is worn down.

6 Claims, 8 Drawing Sheets

SEPARATING DEVICE

This Nonprovisional application claims priority under 35 U.S.C. §119(a) on Patent application No. 2011-086298 filed in Japan on 8 Apr. 2011, the entire contents of which are hereby incorporated by reference.

BACKGROUND OF THE INVENTION (1) Field of the Invention

The present invention relates to a separating device, in particular, relating to a separating device for separating a sheet-like medium stuck on the outer periphery of a photoreceptor drum by means of a separating member.

(2) Description of the Prior Art

Conventionally, in image forming apparatus using electrophotography such as a facsimile machines, printers and the like, image output is carried out by the steps of electrifying a rotationally driven photoreceptor drum by a charger, forming an electrostatic latent image on the photoreceptor drum by irradiation with light in accordance with image information, forming a toner image by applying toner to this electrostatic latent image by means of a developing device and transferring the toner image onto a recording medium such as a sheet medium, paper or the like.

Of such image forming apparatus, there has been known a configuration that includes a separating device for separating the recording medium from the photoreceptor drum by force by bringing a separating member into sliding contact with the photoreceptor drum, in order to prevent the recording medium to which the toner image formed on the photoreceptor drum has been transferred, from remaining electrostatically stuck to the photoreceptor drum.

Next, one example of such a conventional separating device will be described with reference to the drawing.

FIG. 8A is an illustrative diagram showing a state in which a paper separation claw of a conventional separating device is abutting the photoreceptor drum when the claw has been worn down. FIG. 8B is a detailed diagram of the H portion illustrated in FIG. 8A.

As the prior art example of a separating device in an image forming apparatus, in order to forcibly separate the paper (recording medium) from a photoreceptor drum 3, the image forming apparatus is provided with a separating device that is constructed so that a paper separation claw (separating member) 131 of a tapered wedge-shape is applied onto photoreceptor drum 3 with a fixed load so as to mechanically separate the paper attracted to the photoreceptor drum 103 surface as shown in FIG. 8A.

As shown in FIG. 8A, this paper separation claw 131 is pivotally supported by a supporting shaft 132 as a rotational supporting point and urged in the direction of an arrow SP by means of an unillustrated spring member so that the front end 131*a* of paper separation claw 131 abuts against the photoreceptor drum 103 surface with a load as low as 1 g by taking damage to photoreceptor drum 103 into consideration.

Since photoreceptor drum 3 rotates while paper separation claw 131 is being abutted thereagainst, the abutment, designated at 131*b* in the front end 131*a* of paper separation claw 131 becomes worn down with increase in rotating time (the number of sheets) of photoreceptor drum 3, as shown in FIGS. 8A and 8B. If this wearing progresses rapidly, it is impossible to extend the maintenance cycle of the image forming apparatus since the life of paper separation claw 131 is estimated to be short.

Further, when a material having an extremely high wear resistance is used in order to suppress paper separation claw 131 from being worn, this scratches or damages photoreceptor drum 3, causing the problem of shortening the life of photoreceptor drum 103.

Further, as front end 131*a* of paper separation claw 131 is worn down, the front end 131*a* of paper separation claw 131 floats from the photoreceptor drum 103 surface due to a slight eccentricity of photoreceptor drum 3 as the photoreceptor rotates, causing the problem that the required paper separating performance cannot be obtained. That is, if the paper could not be separated from photoreceptor 103 by paper separation claw 131, paper jamming takes place inside the apparatus.

To deal with this, patent document 1 (Japanese Patent Application Laid-open H11-219035) proposes a separating device built in an image forming apparatus in which, as the means of claw-like separating member to be abutted against the photoreceptor drum, the surface of the claw opposing the photoreceptor drum is formed so as to allow the leftover toner on the photoreceptor drum surface to pass therethrough without blocking. This configuration enables the separating device to prevent damage to the photoreceptor drum surface due to local abrasion of the front end part of the claw-like separating member.

On the other hand, patent document 2 (Japanese Patent Application Laid-open 2009-265292) proposes a technology in which the rotational supporting point of the separating member is changed from the photoreceptor in a radial direction of the photoreceptor drum in order to prevent the front end of the separating member that should abut the photoreceptor drum from floating due to eccentricity of the photoreceptor drum during rotation to secure stable separation performance of the separating member, suppress foreign substances from building up between the photoreceptor drum and the separating member and suppress abrasion on the photoreceptor surface.

However, since, in the configuration shown in patent document 1, the position of the rotational axis that enables the claw-like separating member to pivot is fixed, the front end part of the claw-like separating member is abraded so that the contact area of the claw-like separating member with the photoreceptor drum becomes greater, causing the problem that the front end part (the tip of the contact surface) of the claw-like separating member floats due to eccentricity of the photoreceptor drum, resulting in separation failure. Further, as the contact area between the claw-like separating member and the photoreceptor drum becomes greater, the risk of foreign substances building up between the claw-like separating member and the photoreceptor drum becomes higher, giving rise to a problem that the foreign substances accelerate abrasion of the photoreceptor drum.

In the configuration of patent document 2, though it is possible to secure stable separation performance over a long period and achieve long lives of the separating member and photoreceptor drum, it is necessary to provide a mechanism or other means for changing the position of the rotational supporting point of the separation claw. Further, no consideration is given about the influence of the reactive force the separating member receives from the photoreceptor drum and the rotational moment generated in the separating member, resulting from the enlargement and complexity of the arrangement around the separating member, hence there occurs the problem that the front end of the separating member abutting against the photoreceptor drum floats.

SUMMARY OF THE INVENTION

The present invention has been devised in view of the above-described circumstances, it is therefore an object of the present invention to provide a separating device that can prevent the front end of the separating member that abuts the photoreceptor drum from floating and can lengthen the lives of the separating member and photoreceptor drum by suppressing abrasion of the photoreceptor drum surface.

In order to solve the above problems, the present invention is configured as follows:

According to one aspect of the present invention, a separating device for separating a sheet medium being stuck on an outer peripheral surface of a photoreceptor drum, the separating device includes: a separating member that abuts the sheet medium being conveyed along an outer peripheral surface of the photoreceptor drum and separates the sheet medium from the photoreceptor drum; a separating member driver that causes the separating member to abut on and separate from the photoreceptor drum and changes a position of a rotational supporting point of the separating member, and wherein the separating member has a tapered, wedge-shaped front end that abuts the outer peripheral surface of the photoreceptor drum, the front end is rotatably supported in such a manner as to rotate about the rotational supporting point that is disposed on a line parallel to an axis of the photoreceptor drum, and the separating member driver changes the position of the rotational supporting point so that, as larger reactive force that occurs at a contact point where the front end comes in contact with the photoreceptor drum on the outer peripheral surface of the photoreceptor drum, so as to decrease rotational moment of the reactive force on the rotational supporting point of the separating member is lower.

According to another aspect of the present invention, the separating device is such that the separation member driver changes the position of the rotational supporting point of the separating member from an outer side toward an interior side with respect to a tangent line at the contact point.

According to another aspect of the present invention, the separating device is such that the separating member driver changes the position of the rotational supporting point of the separating member as an amount of abrasion at the front end of the separating member increases.

According to another aspect of the present invention, the separating device is such that the separating member driver changes the position of the rotational supporting point of the separating member, in a direction along the plane that is formed by a rotational axis of the photoreceptor drum and a rotational axis of a transfer roller.

According to another aspect of the present invention, the separating device is such that the separating member driver changes the position of the rotational supporting point of the separating member, in such a direction as to increase an inclined angle formed with respect to the tangent line at the contact point as a reference.

With the aspect of the present invention, a separating device for separating a sheet medium being stuck on an outer peripheral surface of a photoreceptor drum, the separating device includes: a separating member that abuts the sheet medium being conveyed along an outer peripheral surface of the photoreceptor drum and separates the sheet medium from the photoreceptor drum; a separating member driver that causes the separating member to abut on and separate from the photoreceptor drum and changes a position of a rotational supporting point of the separating member, and wherein the separating member has a tapered, wedge-shaped front end that abuts the outer peripheral surface of the photoreceptor drum, the front end is rotatably supported in such a manner as to rotate about the rotational supporting point that is disposed on a line parallel to an axis of the photoreceptor drum, and the separating member driver changes the position of the rotational supporting point so that, as larger reactive force that occurs at a contact point where the front end comes in contact with the photoreceptor drum on the outer peripheral surface of the photoreceptor drum, so as to decrease rotational moment of the reactive force on the rotational supporting point of the separating member is lower, so that this configuration can prevent the front end of the separating member that abuts the photoreceptor drum from floating and secure stable separating performance of the separating member, and also is markedly effective to lengthen the lives of the separating member and the photoreceptor drum by suppressing abrasion of the photoreceptor drum surface.

With the aspect of the present invention, the separation member driver changes the position of the rotational supporting point of the separating member from an outer side toward an interior side with respect to a tangent line at the contact point, which makes it possible to decrease the rotational moment that occurs at the separating member by moving the position of the rotational supporting point of the separating member from the outer side to the inner side with respect to the tangent line at the contact point, and hence reduce abrasion of the surfaces of the separating member and the photoreceptor drum. As a result, this configuration can markedly, effectively lengthen the part lives of the separating member and the photoreceptor drum.

With the aspect of the present invention, the separating member driver changes the position of the rotational supporting point of the separating member as an amount of abrasion at the front end of the separating member increases. Accordingly, this configuration makes it possible to secure stable separating performance of the separating member and also suppress abrasion of the surfaces of the separating member and the photoreceptor drum. As a result, this configuration can markedly, effectively in lengthen the part lives of the separating member and the photoreceptor drum.

With the aspect of the present invention, the separating member driver changes the position of the rotational supporting point of the separating member, in a direction along the plane that is formed by a rotational axis of the photoreceptor drum and a rotational axis of a transfer roller or in such a direction as to increase an inclined angle formed with respect to the tangent line at the contact point as a reference, so that it is hence possible to secure stable separating performance of the separating member, and suppress abrasion of the surfaces of the separating member and the photoreceptor drum. As a result, this configuration can markedly, effectively lengthen the part lives of the separating member and the photoreceptor drum.

DESCRIPTION OF THE PREFERRED EMBODIMENTS

Figure 1:
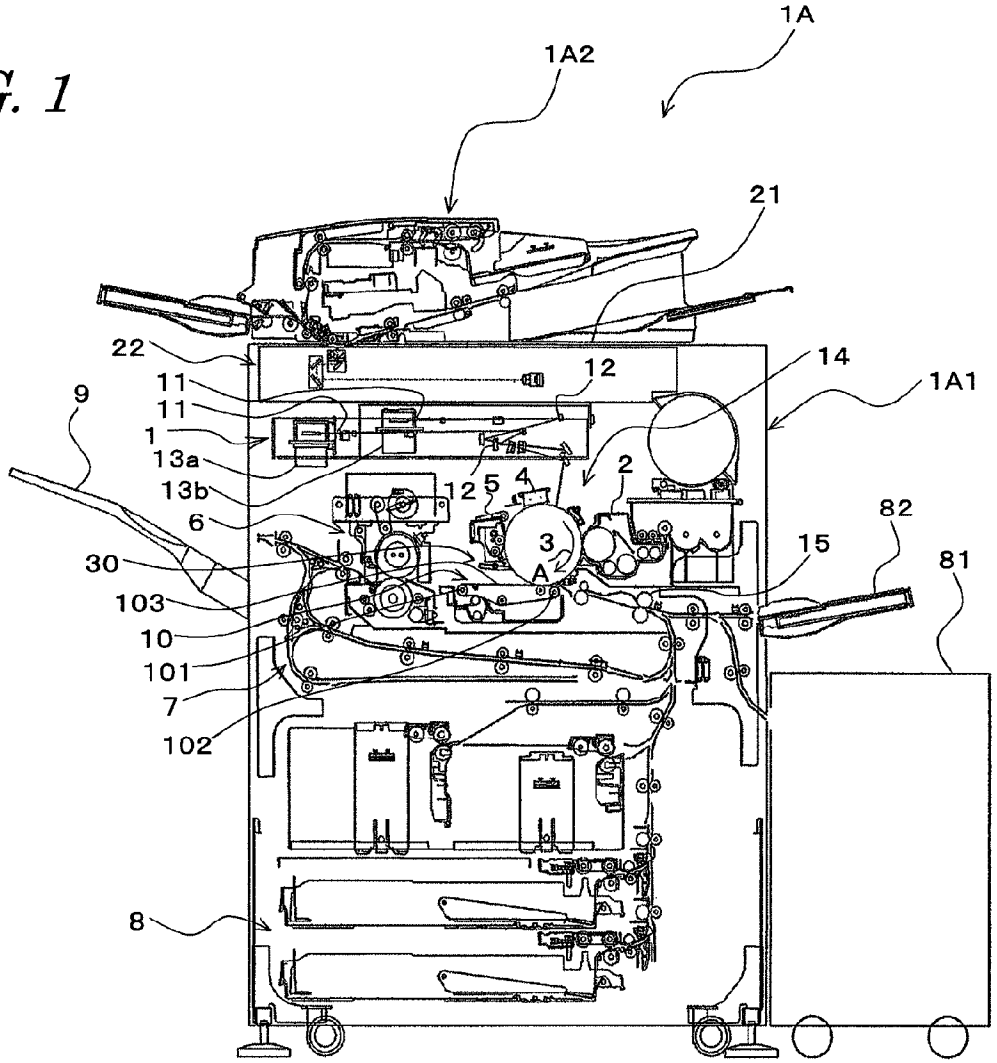
FIG. 1 is a schematic diagram showing an overall configuration of an image forming apparatus including a separating device according to the present embodiment.
Figure 2:
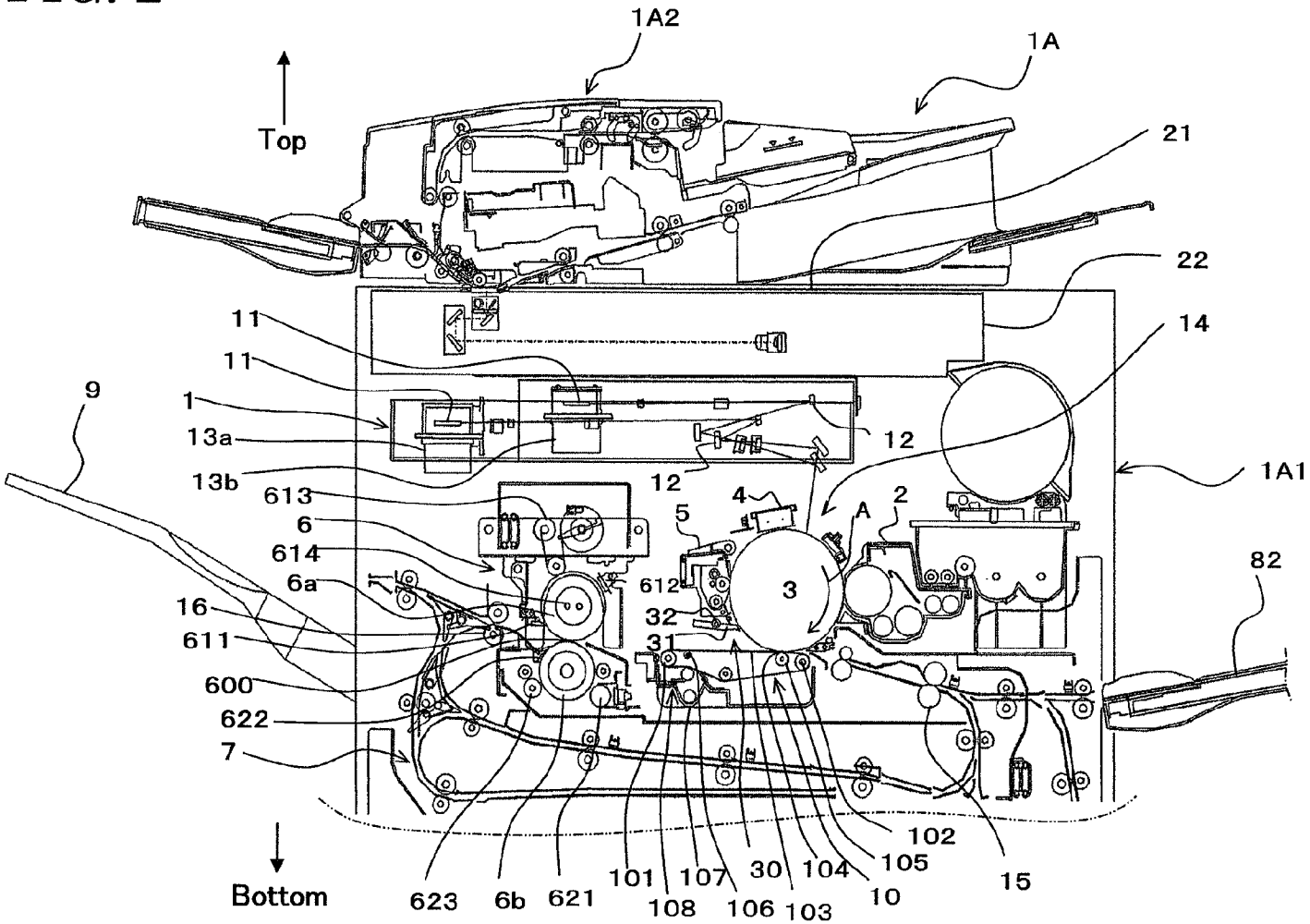
FIG. 2 is a partial detailed diagram showing a configuration of a machine body of an image forming apparatus including a separating device according to the present embodiment.

Referring next to the drawings, a separating device 30 according to the present embodiment will be described in detail. FIG. 1 is an illustrative diagram showing the overall configuration of an image forming apparatus including a separating device according to the present embodiment. FIG. 2 is a partial detailed diagram showing the configuration of the machine body of the image forming apparatus.

Separating device 30 according to the present embodiment includes a separation claw (separating member) 31 that abuts the paper (sheet medium) conveyed along the outer peripheral surface of a photoreceptor drum 3 to separate the paper from photoreceptor drum 3; and a separation claw driving mechanism (separating member driver) 32 for abutting and releasing separation claw 31 to and from photoreceptor drum 3, and is configured to separate the paper stuck to the outer peripheral surface of photoreceptor drum 3.

Figure 3A:
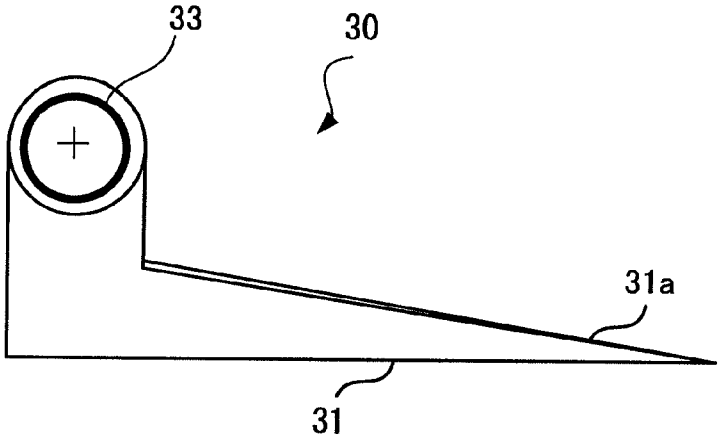
FIG. 3A is a schematic diagram showing a configuration of a separation claw of a separating device according to the present embodiment, FIG. 3B a schematic diagram showing the configuration of the separating device according to the present embodiment.

As shown in FIG. 3A, separation claw 31 is constructed so that the separating part (front end) 31*a* that abuts the outer peripheral surface of photoreceptor drum 3 is formed at one end while the other end is formed with a supporting shaft attachment hole (not shown). Separating part 31*a* is rotatably arranged on an aftermentioned supporting shaft 33 as a rotational supporting point. Separating part (front end) 31*a* is formed in a tapered, wedged shape such that it goes narrower toward the front end.

Further, separation claw 31 has such a configuration that separating part (front end) 31*a* is urged in the direction of an arrow SP by means of an unillustrated spring member (e.g., a member such as a coil or the like that provides spring force) and pressed toward the photoreceptor drum 3 side.

Further, in separating device 30, supporting shaft 33 is rotatably engaged into the supporting shaft attachment hole (not shown) of separation claw 31 so as to be integrated with separating part 31*a*. Separation claw 31 rotates about supporting shaft 33 as a rotational supporting point. The direction of rotation of supporting shaft 33 is perpendicular to the axial direction of photoreceptor drum 3.

Figure 3B:
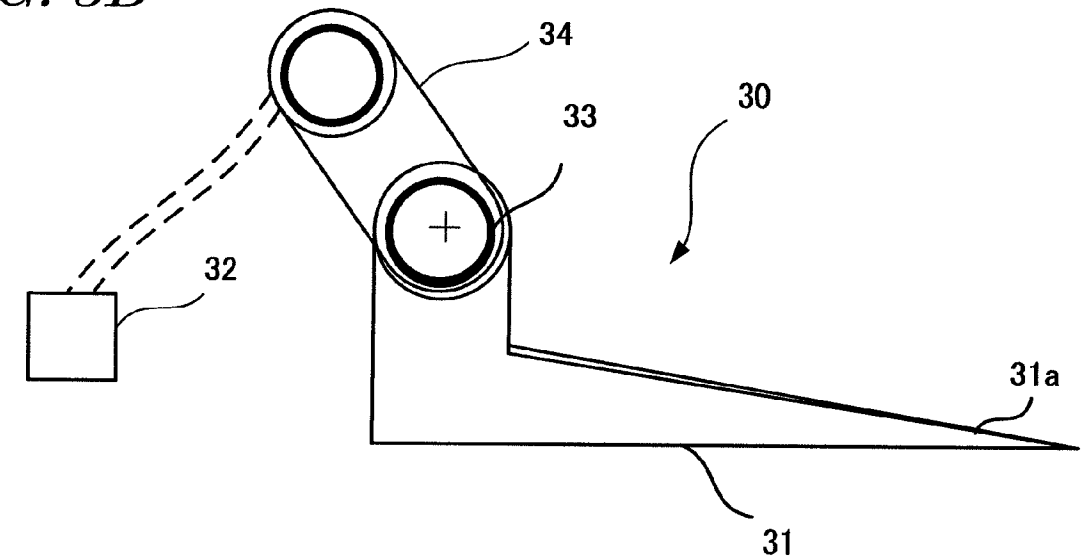

Separation claw driving mechanism 32 changes the position of supporting shaft 33 as the rotational supporting point of separation claw 31 by means of an arm 34, as shown in FIG. 3B. Separation claw driving mechanism 32 are connected to arm 34 by an unillustrated cable. Here, a portion to change the position of supporting shaft 33 as the rotational supporting point of separation claw 31 should not be limited to the above, but may include a solenoid or the like.

Figure 5:
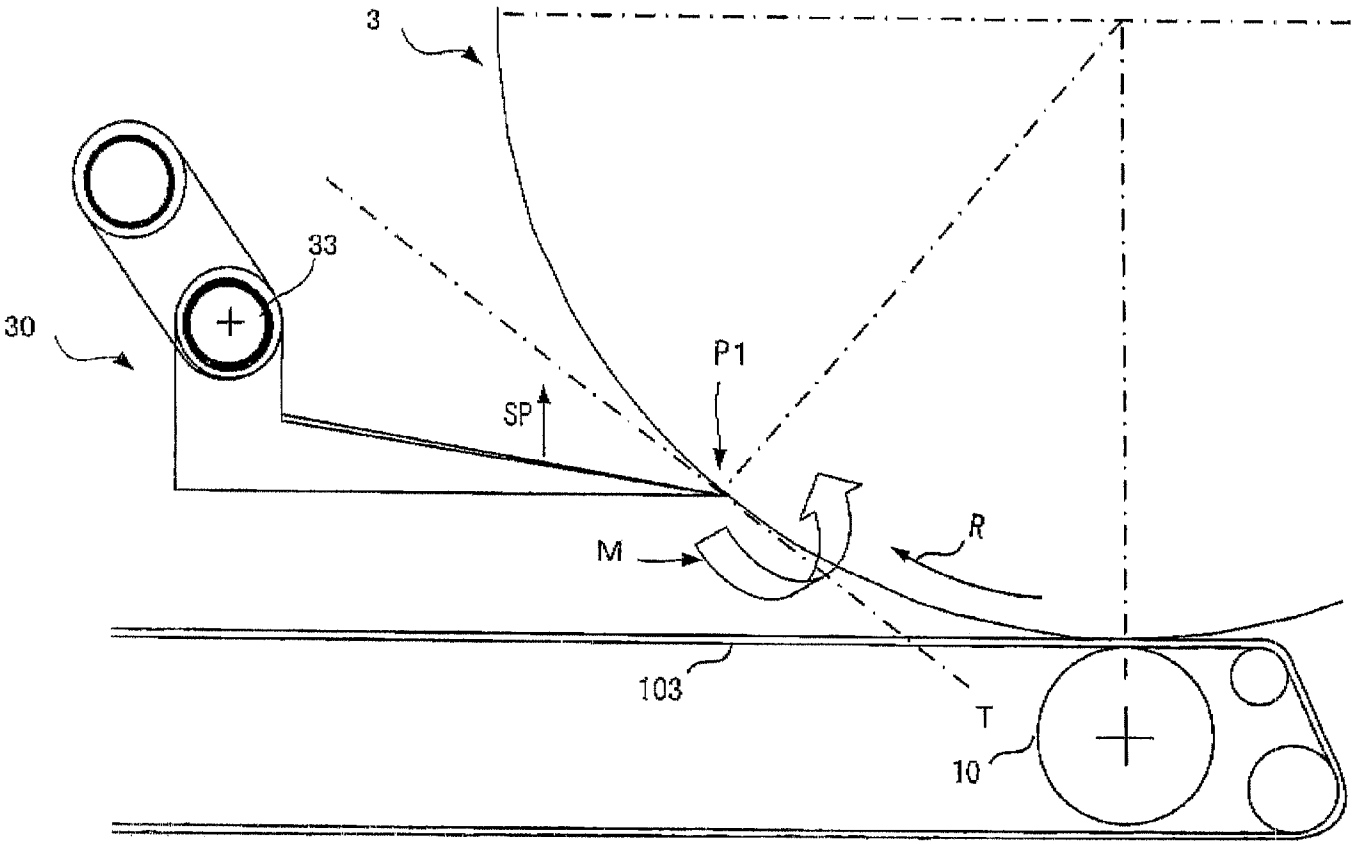
FIG. 5 is a schematic diagram showing a state where the separating device according to the present embodiment abuts a photoreceptor drum.

Further, supporting shaft 33 is positioned such that separating part (front end) 31*a* of separation claw 31 obliquely abuts the outer peripheral surface of photoreceptor drum 3 against the rotational direction of photoreceptor drum 3 (designated by arrow R in FIG. 5). Separating part 31*a* of separation claw 31 abuts photoreceptor drum 3 at a contact point P on the outer peripheral surface.

In the present embodiment, the position of supporting shaft 33 as the rotational supporting point of separating device 30 is expressed with reference to the tangent line T1 at the contact point P1. The side near to photoreceptor drum 3 with respect to tangent line T1 is referred to as an inner side and the opposite side is referred to as an outer side.

Figure 4:
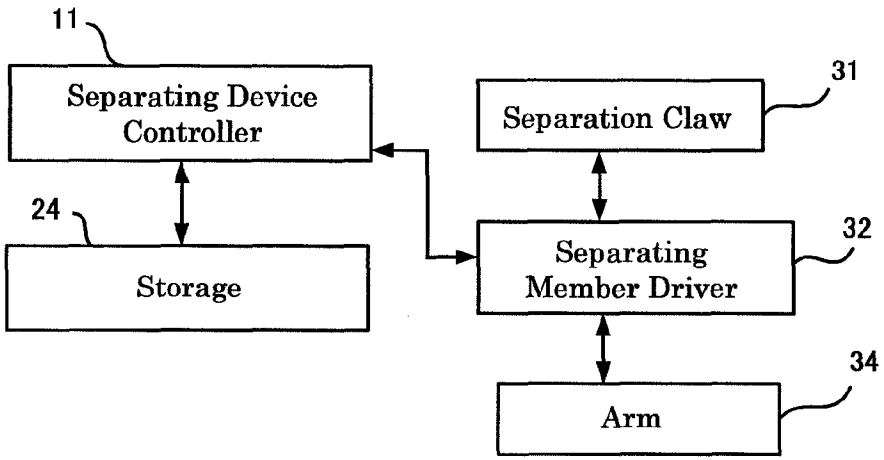
FIG. 4 is a block diagram showing the separating device according to the present embodiment.

FIG. 4 is a block diagram showing separating device controller 11 for controlling separating device 30. Separating device controller 11 is connected to a storage 24 and separation claw driving mechanism (separating member driver) 32.

Separating device controller 11 controls separating member driver to change the position of supporting shaft 33 as the rotational supporting point of separating device 30. Specifically, separating part 31*a* of separation claw 31 receives a reactive force that occurs on the outer peripheral surface of photoreceptor drum 3, at the contact point P1 where separating part 31*a* and photoreceptor drum 3 come in contact. Accordingly, separating part 31*a* is gradually worn down. As the reactive force that occurs on the outer peripheral surface of photoreceptor drum 3 increases, separating device controller 11 moves the rotational supporting point by controlling the separating member driver so that the rotational moment M of the reactive force at the rotational supporting point of separating device 30 will decrease. Here, it is also possible that separating device controller 11 changes the position of supporting shaft 33 as the rotational supporting point of separating device 30, based on the amount of abrasion, which will be described later.

Separating device controller 11 calculates the amount of abrasion of separating part 31*a* by counting the contact time (rotational time of photoreceptor drum 3) between separating part 31*a* and photoreceptor drum 3. Here, the amount of abrasion should not be limited to this, but may be calculated by estimating the number of sheets that have passed through photoreceptor drum 3.

Storage 24 stores the amount of abrasion calculated by separating device controller 11. Separating device controller 11 makes use of the amount of abrasion stored in storage 24 to control the position of supporting shaft 33 as the rotational supporting point of separating device 30.

Next, description will be made for the method in which separating device controller 11 changes the position of supporting shaft 33 as the rotational supporting point of separating device 30.

Separating part 31*a* of separating device 30 receives the reactive force that occurs on the outer peripheral surface, the tip of separating part 31*a* becomes worn down, and a rotational moment M causing the tip to bite into photoreceptor drum 3 occurs, as shown in FIG. 5. This rotational moment M causes abrasion on the surfaces of separating part 31*a* and photoreceptor drum 3.

Figure 6:
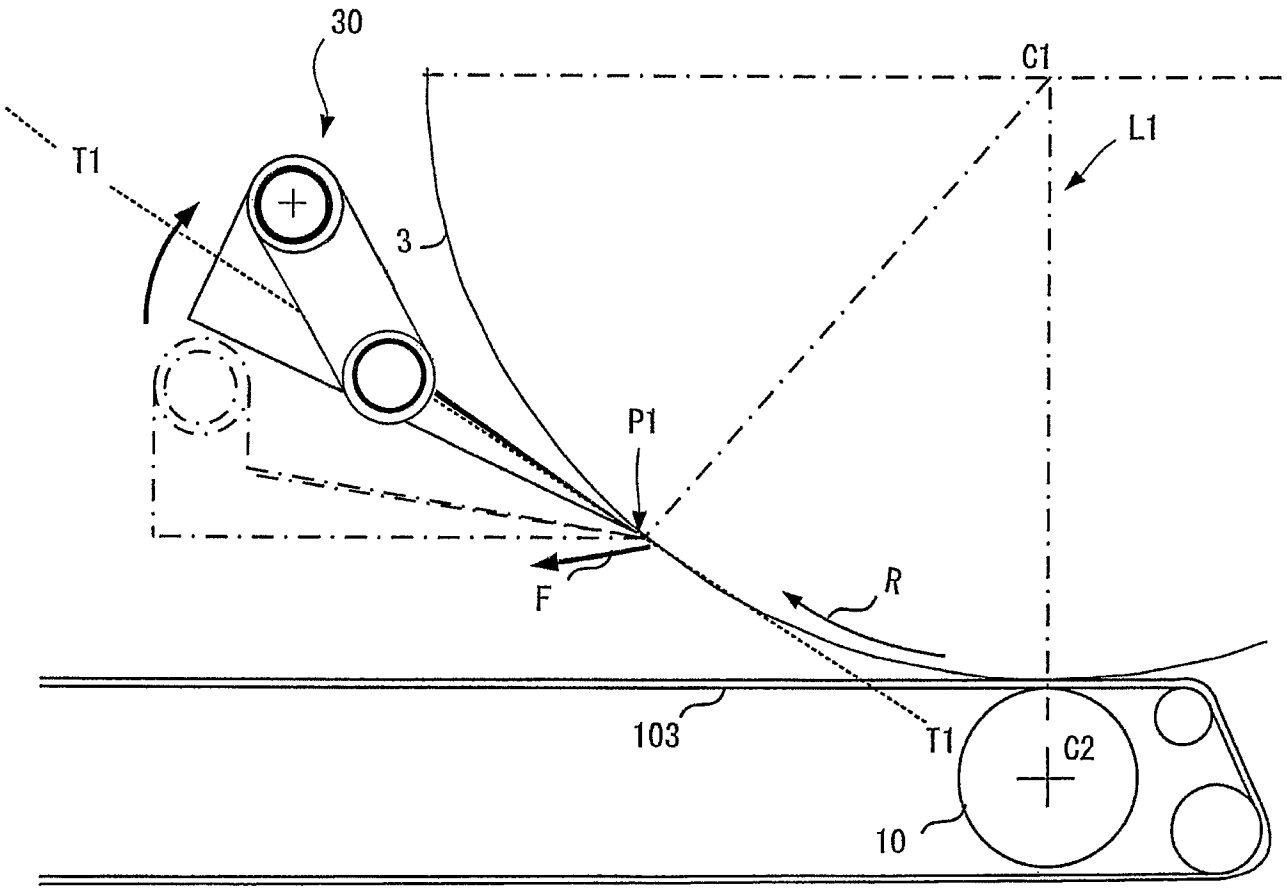
FIG. 6 is an illustrative diagram showing variation of a rotational supporting point of a separating device according to the present embodiment.

As shown in FIG. 6, as the reactive force F that occurs from the outer peripheral surface of photoreceptor drum 3 and acts on separating part 31*a* of separation claw 31 continuously increases, abrasion of separating part 31*a* further progresses. To deal with this, separating device controller 11 changes the position of the rotational supporting point by controlling the separating member driver so as to decrease the rotational moment M of the reactive force about the rotational supporting point of separating device 30. In this case, the position of supporting shaft 33 as the rotational supporting point of separating device 30 is gradually moved from the outer side to the inner side with respect to tangent line T1 at contact point P1 where separating part 31*a* and photoreceptor drum 3 are in contact to each other.

In the above, it is possible to decrease the rotational moment M generated at separating part 31*a* by moving the position of the rotational supporting point from the outer side to the inner side of tangent line T1, it is hence possible to reduce abrasion of separating part 31*a* of separation claw 31 and photoreceptor drum 3.

Next, another method of changing the position of the rotational supporting point, which is different from the above-described method, will be explained.

Figure 7:
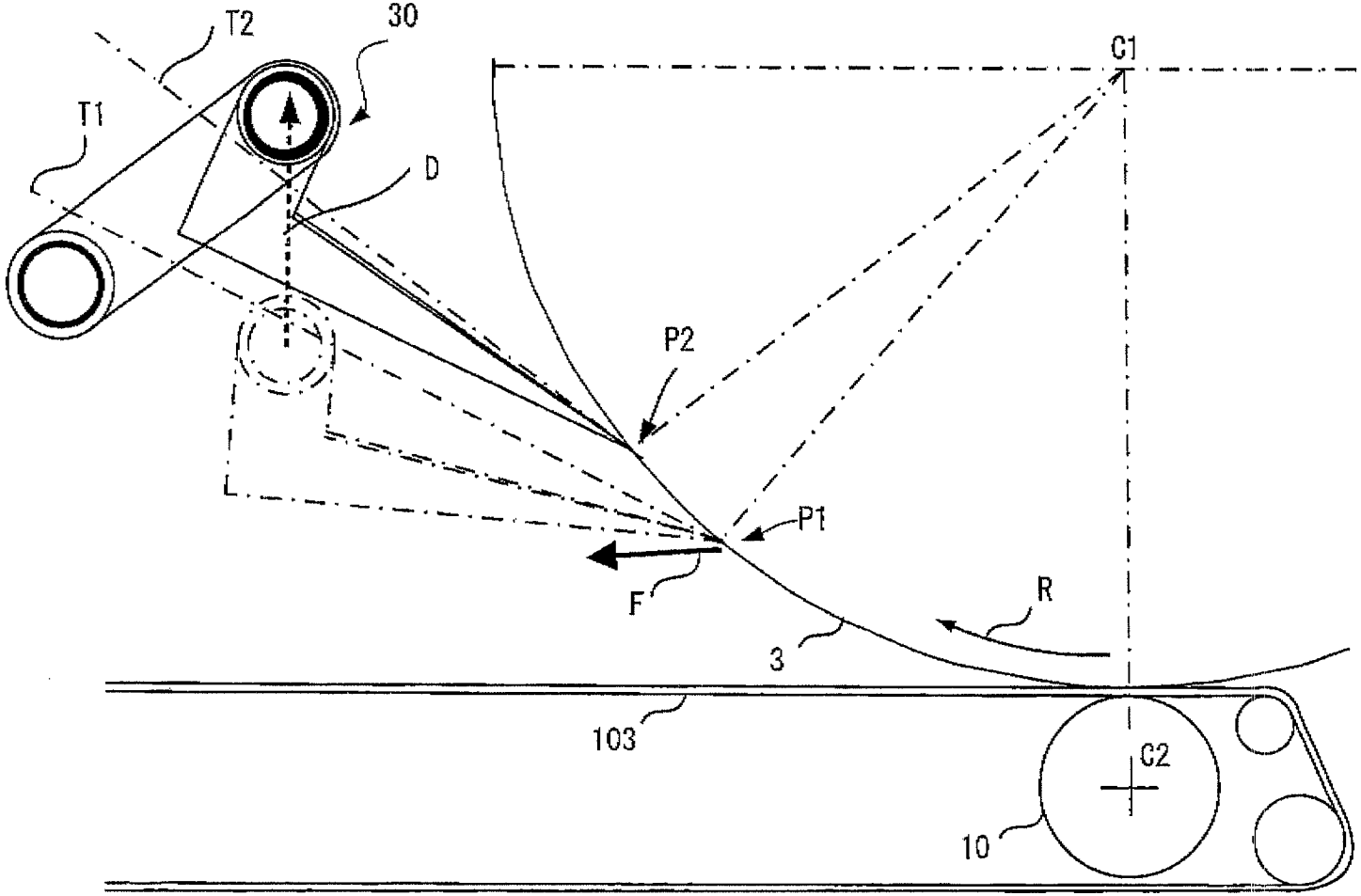
FIG. 7 is an illustrative diagram showing variation of a rotational supporting point of a separating device according to the present embodiment; and, FIG. 8A is an illustrative diagram showing an abutment state where a paper separation claw of a conventional separating device abuts a photoreceptor drum when the claw has been worn down, FIG. 8B a partial enlarged diagram of the H portion in FIG. 8A.
Figure 8A:
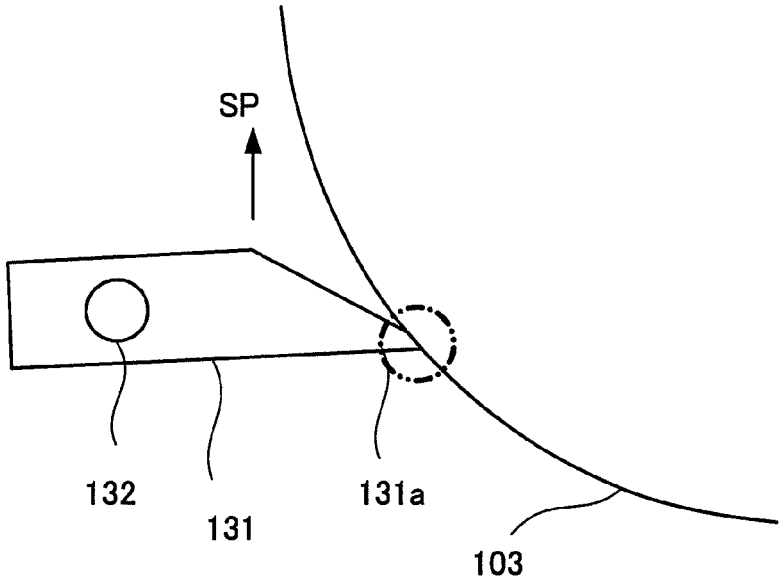
Figure 8B:
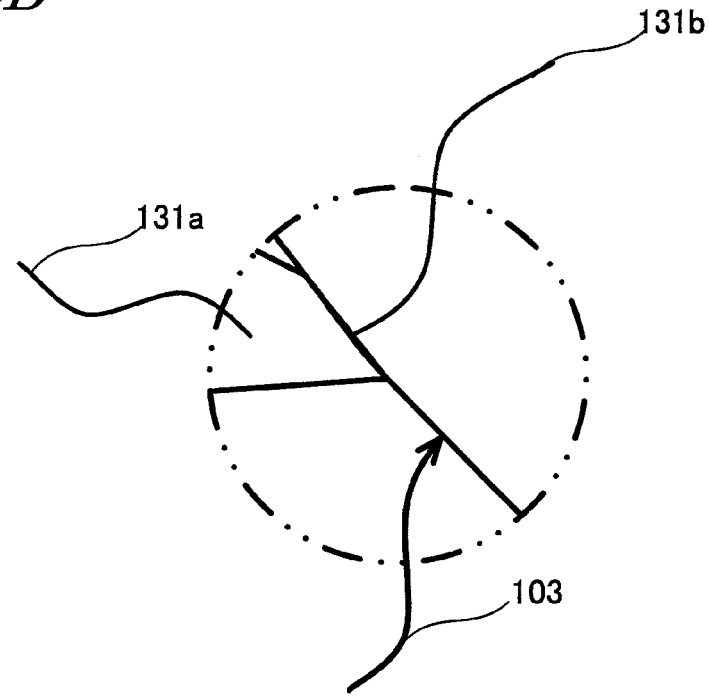

Similarly to the above, the position of supporting shaft 33 as the rotational supporting point of separating device 30 is changed based on separating device controller 11. The point different from the above method of changing the position of the rotational supporting point is that the position of supporting shaft 33 as the rotational supporting point of separating device 30 is moved in the direction along the plane formed by the rotational axis C1 of the photoreceptor drum 3 and the rotational axis C2 of the transfer roller, as shown in FIG. 7.

As the reactive force F that occurs from the outer peripheral surface of photoreceptor drum 3 and acts on separating part 31*a* of separation claw 31 increases, abrasion of separating part 31*a* progresses. To deal with this, separating device controller 11 changes the position of the rotational supporting point in a direction along the plane formed by the photoreceptor drum 3's rotational axis C1 and the transfer roller's rotational axis C2, by controlling the separating member driver so as to decrease the rotational moment M of the reactive force about the rotational supporting point of separating device 30 as the reactive force F that occurs on the outer peripheral surface of photoreceptor drum 3 increases.

When the position of the rotational supporting point is changed, supporting shaft 33 as the rotational supporting point of separating device 30 is moved as indicated by an arrow D so as to be positioned from the outer side to the inner side with respect to the tangent line T2 at a new contact point P2 where separating part 31*a* and photoreceptor drum 3 come in contact. As shown in FIG. 7, the rotational supporting point after variation is positioned on the inner side with respect to tangent line T2 as shown in FIG. 7.

By changing the position of the rotational supporting point of separating device 30 in the direction along the plane defined by the rotational axis C1 of the photoreceptor drum 3 and the rotational axis C2 of the transfer roller, it is possible to secure stable separation performance of separating part 31*a* and inhibit separating part 31*a* and photoreceptor drum 3 from being abraded on their surfaces.

Here, though the position of the rotational supporting point of separating device 30 is changed in the direction along the plane defined by the rotational axis C1 of the photoreceptor drum and the rotational axis C2 of the transfer roller, the invention should not be limited to this. It is also possible to change the rotational supporting point of separating device 30 in such a manner that the inclined angle formed based on tangent line T2 at contact point P2 increases.

What is claimed is:

1. A separating device for separating a sheet medium being stuck on an outer peripheral surface of a photoreceptor drum, the separating device comprising:

a separating member that abuts the sheet medium being conveyed along an outer peripheral surface of the photoreceptor drum and separates the sheet medium from the photoreceptor drum;

a separating member driver that causes the separating member to abut on and separate from the photoreceptor drum and changes a position of a rotational supporting point of the separating member, and a separating device controller configured to measure a used situation of the separating member or the photoreceptor drum, wherein the separating member has a tapered, wedge-shaped front end that abuts the outer peripheral surface of the photoreceptor drum, and the front end abuts with the photoreceptor drum at a contact point and is rotatably supported in such a manner as to rotate about the rotational supporting point that is disposed on a line parallel to an axis of the photoreceptor drum, and the separating member driver changes the position of the rotational supporting point while a state is maintained where the front end abuts with the photoreceptor drum so that, as larger reactive force occurs at the contact point where the front end comes in contact with the photoreceptor drum on the outer peripheral surface of the photoreceptor drum, the rotational moment of the reactive force on the rotational supporting point of the separating member is lower, and the separating member driver rotatably changes the position of the rotational supporting point in such a manner that the rotational supporting point approaches the photoreceptor drum in a circular arc shape using the contact point as a center based on a measurement result in the separating device controller while maintaining the state that the front end abuts with the photoreceptor drum.

2. The separating device according to claim 1, wherein the separation member driver changes the position of the rotational supporting point of the separating member from an outer side toward an interior side with respect to a tangent line at the contact point.

3. The separating device according to claim 1, wherein the separating member driver changes the position of the rotational supporting point of the separating member as an amount of abrasion at the front end of the separating member increases.

4. The separating device according to claim 1, wherein the separating member driver changes the position of the rotational supporting point of the separating member in such a manner as to rotate about the front end, in such a direction as to increase an inclined angle formed with respect to the tangent line at the contact point as a reference.

5. The separating device according to claim 1, wherein the separating member driver changes the position of the rotational supporting point of the separating member toward a direction to get closer to the photoreceptor drum.

6. A separating device for separating a sheet medium being stuck on an outer peripheral surface of a photoreceptor drum, the separating device comprising:

a separating member that abuts the sheet medium being conveyed along an outer peripheral surface of the photoreceptor drum and separates the sheet medium from the photoreceptor drum;

a separating member driver that causes the separating member to abut on and separate from the photoreceptor drum and changes a position of a rotational supporting point of the separating member, and a separating device controller configured to measure a used situation of the separating member or the photoreceptor drum, wherein the separating member has a tapered, wedge-shaped front end that abuts the outer peripheral surface of the photoreceptor drum, and the front end abuts with the photoreceptor drum at a contact point and is rotatably supported in such a manner as to rotate about the rotational supporting point that is disposed on a line parallel to a rotational axis of the photoreceptor drum, the separating member driver changes the position of the rotational supporting point while a state is maintained where the front end abuts with the photoreceptor drum so that, as larger reactive force occurs at the contact point where the front end comes in contact with the photoreceptor drum on the outer peripheral surface of the photoreceptor drum, the rotational moment of the reactive force on the rotational supporting point of the separating member is lower, and the separating member driver changes, based on a measurement result in the separating device controller, the position of the rotational supporting point of the separating member in a parallel manner and in such a manner that the rotational supporting point approaches the photoreceptor drum, in a direction along a plane that is formed by a rotational axis of the photoreceptor drum and the rotational axis of a transfer roller, the direction being a downstream side of a rotational direction of the photoreceptor drum, and during the changing of the position of the rotational supporting point in the parallel manner, the contact point is changed from a first relative position relative to the rotational axis of the photoreceptor drum, to a second relative position relative to the rotational axis of the photoreceptor drum.

* * * * *